US005577967A

United States Patent [19]

Durso

[11] Patent Number: 5,577,967

[45] Date of Patent: Nov. 26, 1996

[54] GOLF SWING PRACTICE DEVICE

[75] Inventor: Joseph M. Durso, Reston, Va.

[73] Assignee: IBEX Golf L.C., Reston, Va.

[21] Appl. No.: 541,490

[22] Filed: Oct. 10, 1995

[51] Int. Cl.[6] ..... A63B 69/36

[52] U.S. Cl. ..... 473/279; 273/DIG. 30; 473/162

[58] Field of Search ..... 473/278, 279, 473/160, 162

[56] References Cited

U.S. PATENT DOCUMENTS

| | | | |
|---|---|---|---|
| 5,028,052 | 7/1991 | Miller | 473/278 |
| 5,110,133 | 5/1992 | Durso | 273/DIG. 30 |
| 5,354,064 | 10/1994 | Toikka | 473/278 |
| 5,398,937 | 3/1995 | Regan | 273/DIG. 30 |

FOREIGN PATENT DOCUMENTS

92/01496 2/1992 WIPO .

*Primary Examiner*—George J. Marlo
*Attorney, Agent, or Firm*—Christopher John Rudy

[57] ABSTRACT

A golf swing practice pad has a flat, generally elongate base having a length and a width; means for securing the base to a practice surface; a generally elongate hitting surface having a length, and having a width wider than the width of the base; and means for adjustably attaching the hitting surface to the base. Advantageously, the pad has a special tee slot in its base. The pad is useful in golfing instruction and practice. In another aspect, a method for attaching web material to plastic stock embraces heating the plastic stock, for instance, heating thermoplastic pellets to provide heated plastic stock, which may be extruded from a die, contacting the heated plastic stock and the web and passing the same through a sizing device, under conditions such that the web is attached to the stock. Another aspect embraces attached web and stock materials, including a loop web for hook and loop attachment melded to the practice pad base. A further aspect includes an article useful for golf swing training having a durable tongue material with a cul-de-sac shaped notch to accommodate the positioning of a rubber practice tee for a golf ball by slipping the post of the tee sidewardly through a neck of the notch from outside the tongue such that the post can rest in a larger hole of the notch with the base of the rubber tee under the tongue.

8 Claims, 2 Drawing Sheets

GOLF SWING PRACTICE DEVICE

FIELD

This invention concerns a golf practice article, its preparation and use. It also concerns attachment of a web material, e.g., a hook and/or loop web, to a plastic stock.

BACKGROUND

As recounted in Durso, U.S. Pat. No. 5,110,133 (May 5, 1992), golf is one of the most difficult to play of popular games in the world. It generally requires specific instruction, repeated application, i.e., perfect practice, concentration, and success under the pressure of competition in order to feel confident and skilled at every aspect of the game. For golfers this can be, and in many cases is, a lifelong endeavor. Lack of time, patience and discipline, compounded by a lack of a convenient place to practice, make it difficult for most golfers to practice effectively, as they must, to improve the score of their game. Often, unfortunately, when most golfers do practice, imperfect practice renders much of the time and effort spent of little if any value because such such imperfect efforts cannot be repeated with success on the golf course under the pressure of playing conditions.

In addressing the foregoing, Mr. Durso invented and disclosed in the aforementioned patent a golf swing training device comprising a flat, substantially rectangular base having two forwardly directable edges a predetermined distance apart; means for securing the base to a practice surface; a substantially rectangular hitting surface having two forwardly directable edges spaced apart a predetermined distance between the two forwardly directable edges of the base; and means for adjustably attaching the hitting surface to the base. See also, Durso, WO 92/01496 (Jun. 2, 1992).

The foregoing invention has many significant advantages, not the least of which include portability, and authenticity of swing practice, particularly when practicing iron shots.

Yet, that device has certain drawbacks. These include manufacturing ease and most extended durability. Also, even more perfect, natural and effective practice is desirable.

SUMMARY

The present invention provides a golf swing practice pad comprising a flat, generally elongate base having a length and a width; means for securing the base to a practice surface; a generally elongate hitting surface having a length, and having a width wider than the width of the base; and means for adjustably attaching the hitting surface to the base—and golfing therewith. In another aspect, a method for attaching web material to plastic stock comprises heating the plastic stock, contacting heated plastic stock and the web and passing the same through a sizing device, under conditions such that the web is attached to the stock. Another aspect comprises attached web and stock materials. A further aspect comprises an article useful for golf swing training comprising a durable tongue material having a cul-de-sac shaped notch therein which can accommodate the positioning of a rubber practice tee for a golf ball having a base and a post by slipping the post of the tee sidewardly through a neck of the notch from outside the tongue such that the post can rest in a larger hole of the notch with the base of the tee under the tongue.

The invention is a useful recreational device, and its method is useful for combining materials. In particular, the method can be used to attach a web material, as means for adjustably attaching the hitting surface, to the base, and for other objects such as a loop material to a golf bag, and so forth.

The invention provides for even more perfect, more natural and effective golf practice in a portable device. It is sturdy, pleasing to the eye, and efficient to make. In its broader aspects, the invention can be employed to make combined materials efficiently.

Numerous further advantages attend the invention.

DRAWINGS

The drawings form part of the specification hereof. In the drawings, in which like numerals refer to like features, the following is briefly noted:

ILLUSTRATIVE DETAIL

Figure 1:
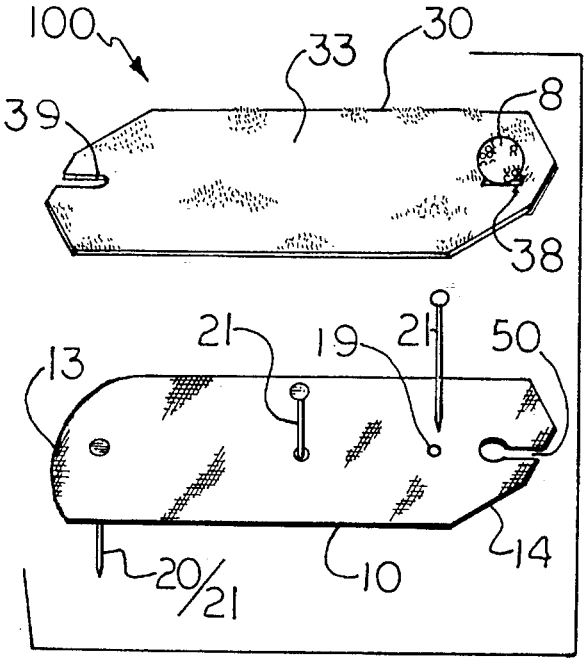
FIG. 1 is a perspective, exploded view of a golf swing practice pad of the invention, having turf and tee slots.
Figure 2:
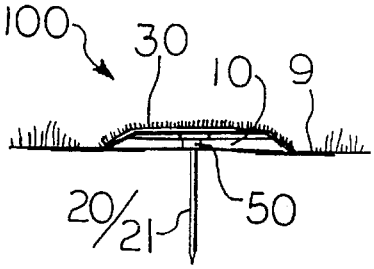
FIG. 2 is a front elevational view of the pad of FIG. 1.
Figure 3:
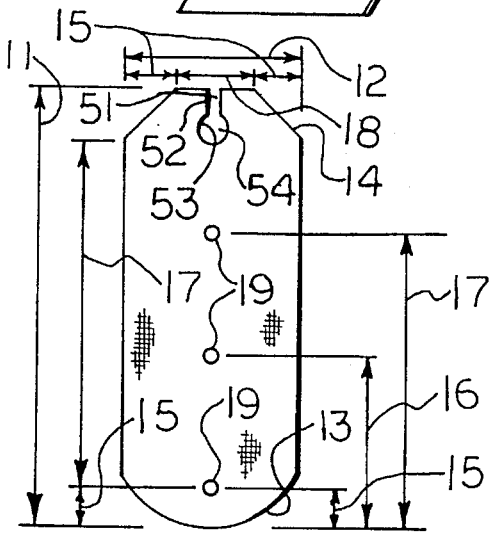
FIG. 3 is a top view of a base of the pad of FIGS. 1–2.

The invention is further illustrated with the following detail, which generally may be taken in conjunction with the drawings, and is not to be construed as limiting in nature.

In reference to the drawings, and particularly in reference to FIGS. 1–6, golf swing practice pad 100 has flat, generally elongate base 10 with length 11 and width 12. The pad 100 has means 20 for securing the base 10 to practice surface 9, generally elongate hitting surface 30 having length 31 and with width 32 wider than the width 12 of the base 10, and means 40 for adjustably attaching the hitting surface 30 to the base 10.

Preferably, the base 10 is generally made from a suitably strong, supple substance, which is durable and weather-resistant. A polyester containing polymer, for example, VANDAR 2100 polyester containing polymer, may be employed in this connection. The base 10 may be considered to be generally rectangular in shape and may have contoured rear end 13 and wedged front end 14. Auxiliary linear measures 15, 16, 17 & 18 may subdivide part(s) of length 11 and/or width 12. Holes 19 can be present in the base 10.

Preferably, the means 20 for securing the base 10 to the practice surface 9 includes nails 21, for example, three 6-inch (15.2-centimeter (cm)) aluminum gutter nails, or other nails such as stainless steel nails, and so forth and the like, which can be passed through holes 19 and driven to secure the base 10 to a natural turf or ground practice surface 9. Screwing or corkscrew-type, or other, means 20 may be employed also.

Preferably, the hitting surface 30 has turf 33 and back 34 and is generally made of an artificial turf material in imitation of natural turf such as of nylon and so forth, for example, of approximately ⅜-inch (0.95-cm) deep ASTRO TURF material with tied warp lines on the back 34 directed forwardly. The back 34 may be completely coated with an epoxy material such as an epoxy glue 35. A hook strip 41, e.g., of 2-inch (5-cm) wide VELCRO hook material, part of a preferred hook and loop means 40, may extend lengthwise on back 32 of the hitting surface 30 and be glued in place with glue such as epoxy glue underneath it only, or with part of the epoxy glue coat 35. In either case, when cured, the glued area generally imparts a curve to the hitting surface 30, as through drawing together of warp and/or woof elements at the back 34 of the hitting surface 30. Thus, the hitting surface 30 can be slightly convex, especially along forwardly directable edges 36, which causes these edges to bend down slightly—especially when part of the means for attaching is a part of a hook and look combination in strip form which is of a more narrow width than the width 32—when attached to the base. This blends into a grass practice surface 9 very well, which imparts additional realism into the practice. With the aforementioned prior practice device one drawback, overcome hereby, was that a golfer could sense an unnatural edge or mark along the hitting surface, particularly in the practice of an iron shot. If the golfer sensed an unnatural edge or mark, he would feel as if he were hitting off an object that needs to be considered but which would not be there in actual play, which would result in practice which is far less effective than that provided hereby. The hitting surface 30 may be symmetrical about its "x" (lengthwise) and/or "y" (widthwise) axes, and have wedged ends 37. Preferably, the hitting surface 30 is at least symmetrical about its lengthwise axis. Turf slots 38, for example, about 1-inch by ⅜-inch (2.5-cm×0.95-cm) through the turf 33 and even through back 34, but typically of a narrower width thereat, can accommodate golf ball 8. This allows for side hill lies, i.e., use of the practice pad on the side of a hill, as well as provides for a very realistic lie in that in actual play the ball never lies high on top of the grass but slightly into it, as the pad 100 effectively imitates. See FIG. 1. Tee slots 39, for example, about 1-inch (2.5-cm) deep by ⅝-inch (1.6-cm) in width with an about 5/16-inch (0.8-cm) radius may accommodate the post of a standard rubber practice tee. See, FIG. 5. The slots 38 & 39 may be provided by cutting, melting and/or burning. The double-ended feature (slots to encourage teeing or setting up the ball at both ends of the hitting surface 30) allows for greatly extended if not almost unlimited use before the hitting surface 30 requires replacement.

Preferably, the means 40 for adjustably attaching the hitting surface to the base embraces a hook and loop arrangement between the hitting surface 30 and base 10 if not essentially integral therewith. For example, the hook strip 41, e.g., of 2-inch (5-cm) wide VELCRO hook material, may extend lengthwise on back 32 of the hitting surface 30 and be glued in place with epoxy glue, and loop strip 42, e.g., of a polyester containing VELCRO loop material, may cover an entire side of the base 10 and be combined with the VANDAR 2100 polyester containing polymer by melding the loop web and polymer stock materials together in processing.

Figure 7:
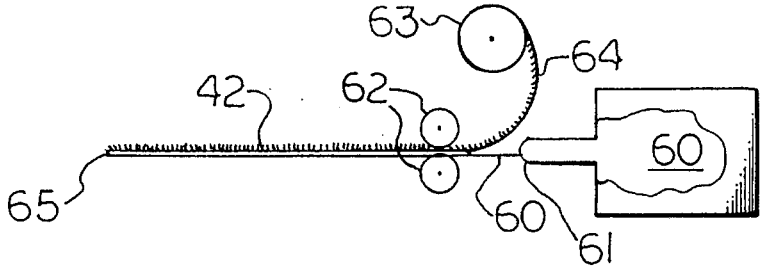
FIG. 7 is a side view of attachment of web to stock.

Generally, as depicted in FIG. 7, as hot base polymer stock 60, typically obtained from melting and mixing of plastic pellets, is extruded through extrusion die 61 and passed through a sizing device, i.e., e.g., rollers 62, web 63 is fed and contacted on its back 64 with the hot stock 60 and pressed into the hot stock 60 by the rollers 62 with the stock 60 and web 63 combination still pliable and semi-molten. Melded material 65 is provided, without the need for added adhesives. The melded material 65 is then cooled and may be cut to size as desired. The stock 60 and web 63 are compatible, which can include these being of the same or similar chemical make up, so that they actually become one item, for example, base 10 with loop 42. Polyester thermoplastic materials may be used to advantage. More particularly, for example, as the web, the polyester containing VELCRO loop material 42 may be employed, and as stock, the polyester containing VANDAR 2100 polymer may be employed to advantage.

Accordingly, with such a method, the base 10 is made to have quite integrally therewith a part of the preferred hook and loop means 40 for adjustably attaching the hitting surface to the base. This solves a problem of the prior golf swing training device of how to efficiently make arrangements to hold a VELCRO material to a plastic base regardless of the temperature or how long it has been used. Therefore, the base 10 with the attached part of the means 40 is quite absolutely impervious to the weather and does not require protection from the elements. Boundaries, holes and notches, especially in the base 10, may be made by cutting, drilling, melting and/or burning as is well-known.

Moreover, such a method can provide attached web and stock materials. For example, in the golfing field, such a polyester VELCRO loop and polyester VANDAR 2100 melded combination can be cut or modified for attachment to a golf bag so as to hold VELCRO hook-containing accessories such as gloves, towels, scorecards, cigarette packs, food packs, and so forth. In other fields, the well-backed web material as melded with the stock material can find many other uses.

Figure 4:
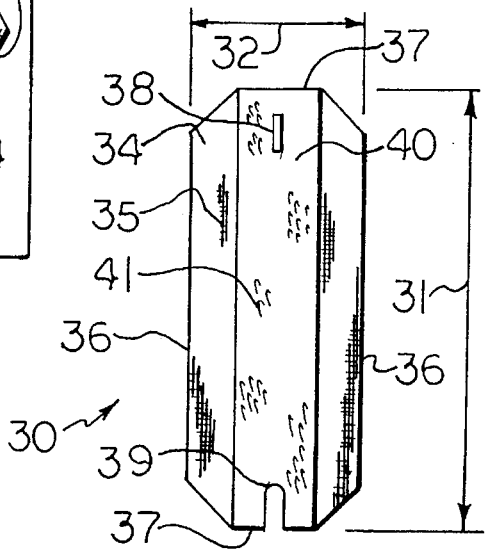
FIG. 4 is a bottom view of a hitting surface of the pad of FIGS. 1–2.
Figure 5:
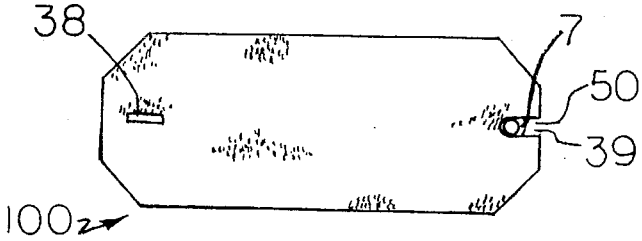
FIG. 5 is a top view of the pad of FIGS. 1–4 with a tee.
Figure 6:
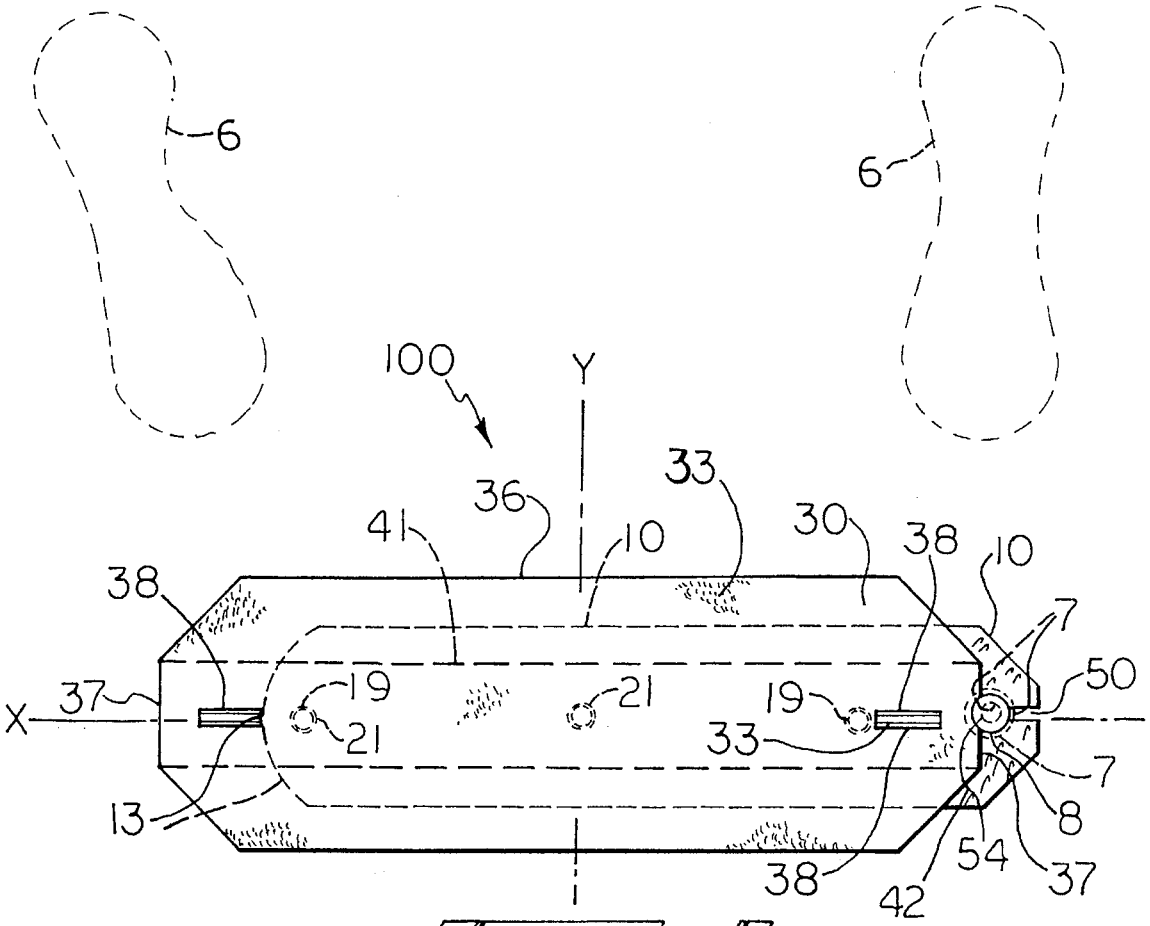
FIG. 6 is a top view of another golf swing practice pad hereof, having two turf slots in its hitting surface.

Turning again to FIGS. 1–6, advantageously, tee slot 50 is present in the base 10. The tee slot 50 may be present alone as with a tongue with tee slot 50 article where the "tongue" is considered to be a form of the base 10 apart from an attachable hitting surface. Such an article is useful for golf swing training and is made of a durable material such as a polyester, polyurethane, polyacetate, nylon, and so forth plastic, as with the base 10. The slot 50 is a cul-de-sac shaped notch generally defined by neck 51 having length 52 and width 53 and wider diameter hole 54. The tee slot 50 can accommodate the positioning of a virtually indestructible rubber practice tee 7 having a base 6 and a post 5 by slipping the post of the tee sidewardly through the neck 51 from outside the tongue of base 10 such that the post part of the tee 7 can rest in the larger hole 54 with the base of the tee 7 under the tongue of base 10. As is well known, golf ball 8 can be teed up on the post of the tee 7. Alone, the tongue and tee slot article may be fastened onto the practice surface 9 as by nailing or spiking it into the ground, or a base or other surface, especially so that the neck 51 of the slot or notch 50 opening is exposed for insertion of the tee 7, and the tongue may be lifted up for replacement of a tee. When the tongue or base 10 is attachable to an underside of a hitting surface as for golf swing practice, preferably in the pad 100, the notch 50 may be in registry with the tee slot 39 as depicted in FIG. 4, and the base 10 covered by the hitting surface 30; alternatively, the notch 50 may be exposed and not covered by the hitting surface material as depicted in FIG. 6 where two turf slots 38 are present but no tee slot, and the neck 51 of the notch 50 opens outwardly from the hitting surface 30. The tongue or base 10 with its tee slot or notch 50 may be removably attachable to the underside of the hitting surface 30 by means of hook and loop materials, for example, VELCRO hook and loop materials. Thus, the golfer can practice teed shots as they are played from the teeing area on an actual golf course, specifically, with the feet 6 on the practice surface 9, instead of standing on anything artificial, as with large or ordinary golf mats. All the practicing golfer does is set a ball 8 on the rubber tee 7, and begin practice. In the case where no tee slot is present in the hitting surface, one hitting surface end 37 is set up behind the tee 7 so as to imitate the natural turf behind a teed-up lie and provide protection for the driver should the golfer hit low and on the hitting surface 30 or before the tee 7. See, FIG. 6. However, the presence of a tee slot 39 in the hitting surface is preferred since no base lies exposed to distract the golfer, and protection of the base is yet provided. See, FIG. 4.

The pad 100 in this instance with the tee 7 also becomes an excellent backswing guide for the practicing golfer in that it can be set up straight back or at an angle inside the line of flight which suits the training needs of the practicing golfer. Even without a tee, the pad 100 is an excellent backswing or putting stroke guide, and eliminates distracting club alignment indicia as well as it provides a much more natural looking environment to practice with.

The golf swing practice pad of the invention still most effectively allows the practicing golfer to practice curved shots called draw and fade shots. For example, with the pad 100, the golfer is merely instructed to place the club face square to the intended target regardless of the right or left angle to which the hitting surface 30 placement is set. Typically, for such curved shots, a 5-degree right or left adjustment of the hitting surface 30 is made on the base 10. Otherwise, the instructions are exactly the same as those of the device of the aforementioned Durso patent, in that when the golfer placed the club face square to the markings on the prior device, it was actually a way of causing the golfer to always place the club face square to the target, which is the essential element.

Instruction may be by a teacher or by self-teaching.

The pad of the invention is most adaptable to practicing realistic iron shots where the club head is directed into the turf after striking the ball. In fact, it is quite remarkable in the realism it provides, while retaining its characteristics as a repeatable golf stroke practice device.

The golf swing practice pad of the invention may be very portable and light weight. It may include pads with hitting surfaces about from 3 inches (7.6 cm) to a foot (30 cm) in width to about from 6 inches (15 cm) to two feet (61 cm) in length, and weighing from an ounce (28 g) or so or less to half a pound (227 g) or so or more. For example, pad 100 as of FIGS. 1–5 and FIG. 6 may weigh approximately 2½ ounces (72 grams) and include features with the following dimensions, which dimensions may be considered to be approximate:

| Feature | Dimension |
|---|---|
| 10 | ⅛-inch (0.32-cm) thickness. |
| 11 | 11½ inches (29 cm). |
| 12 | 3½ inches (8.9 cm). |
| 15 | 1 inch (2.5 cm). |
| 16 | 5½ inches (14 cm). |
| 17 | 9 inches (23 cm). |
| 18 | 1½ inches (3.8 cm). |
| 19 | 5/16-inch (0.79 cm) diameter. |
| 31 | 11½ inches (29 cm). |
| 32 | 5 inches (13 cm). |
| 52 | ⅜ inch (0.95 cm). |
| 53 | 3/16 inch (0.48 cm). |
| 54 | ⅝-inch (1.6-cm) diameter. |

The invention receives praise from many. For example, the golf swing practice pad of the invention is praised by amateur and professional golfers alike, and the attachment method and its result are praised also.

CONCLUSION

The present invention is thus provided. Numerous modifications can be effected within its spirit, the literal claim scope of which is particularly pointed out as follows:

I claim:

1. A golf swing practice pad comprising a flat, generally elongate base having a length and a width; means for securing the base to a practice surface; a generally elongate hitting surface having a length, and having a width wider than the width of the base; means for adjustably attaching the hitting surface to the base, said means for securing the base to a practice surface comprising a hook and loop combination material, and wherein the hitting surface is an artificial turf material.

2. The pad of claim 1, wherein a part of the means for attaching is a part of the hook and loop combination, in strip form, which is of a more narrow width than the width of the hitting surface, and wherein the hitting surface is slightly convex to cause forwardly directable edges of the hitting surface to bend down slightly.

3. The pad of claim 2, further comprising at least one of the following features:

A) a turf slot in the pad hitting surface, which is capable of retaining a golf ball therein so that the ball nestles into the artificial turf material surface deeper than would be the case if the ball were placed on the artificial turf surface itself; and B) a cul-de-sac shaped tee slot in the pad base, which can accommodate the positioning of a rubber practice tee for a golf ball having a base and a post by slipping the post of the tee sidewardly through a neck of the slot from outside the pad base such that the post can rest in a larger hole of the slot with the tee base under the pad base.

4. The pad of claim 3, wherein the hitting surface is generally symmetrical at least about its lengthwise axis.

5. The pad of claim 1, further comprising at least one of the following features:

A) a turf slot in the pad hitting surface, which is capable of retaining a golf ball therein so that the ball nestles into the pad hitting surface deeper than would be the case if the ball were placed on the pad hitting surface itself; and B) a cul-de-sac shaped tee slot in the pad base, which can accommodate the positioning of a rubber practice tee for a golf ball having a base and a post by slipping the post of the tee sidewardly through a neck of the slot from outside the pad base such that the post can rest in a larger hole of the slot with the tee base under the pad base.

6. A method of providing golf instruction comprising providing a golf swing practice pad as claimed in claim 1, and swinging or directing swinging a golf club at a golf ball placed forwardly on the pad.

7. The method of claim 6, wherein a rubber practice tee is employed by placing the tee in a cul-de-sac shaped notch in the base of the pad, which can accommodate positioning of the tee having a base and a post by slipping the post of the tee sidewardly through a neck of the notch from outside the base of the pad such that the post can rest in a larger hole of the notch with the base of the tee under the base of the pad, and wherein the hitting surface is positioned so that a forward edge thereof is positioned proximate the tee.

8. The method of claim 6, wherein the hitting surface substantially covers the base of the pad.

* * * * *